United States Patent [19]

Lejeune et al.

[11] 4,452,055

[45] Jun. 5, 1984

[54] HORIZONTAL AUTOCLAVE TANK FOR THE TREATMENT OF TEXTILE MATERIALS

[76] Inventors: Alfred Lejeune, 289 Bois d'Achelles, Tourcoing; Jean-Claude Dumoulin, 41 rue Lorthiois, 59420 Mouvaux, both of France

[21] Appl. No.: 445,985

[22] Filed: Dec. 1, 1982

[51] Int. Cl.[3] ..... D06B 5/18

[52] U.S. Cl. ..... 68/189; 68/210

[58] Field of Search ..... 68/189, 184, 181 R, 68/210

[56] References Cited

U.S. PATENT DOCUMENTS

| | | | |
|---|---|---|---|
| 2,792,702 | 5/1957 | Newcomb et al. | 68/189 |
| 3,659,438 | 5/1972 | Chiba et al. | 68/184 X |
| 3,916,653 | 11/1972 | West et al. | 68/189 X |

FOREIGN PATENT DOCUMENTS

| | | | |
|---|---|---|---|
| 2360310 | 6/1975 | Fed. Rep. of Germany | 68/184 |
| 1363047 | 4/1964 | France | 68/189 |
| 757431 | 9/1956 | United Kingdom | 68/184 |

*Primary Examiner*—Philip R. Coe

*Attorney, Agent, or Firm*—Robert E. Burns; Emmanuel J. Lobato; Bruce L. Adams

[57] ABSTRACT

Apparatus for treating textile material for example bleaching or dyeing woven or knitted fabric in rolls or yarn on reels, comprises a horizontal autoclave tank having a removable cover at one end. The tank is divided into a treatment compartment and an expansion compartment and an expansion compartment by a partition of which the height is adjustable to vary the amount of liquid in the treatment compartment. The material to be treated is placed on a horizontal perforated cylindrical holder which is closed at one end and at the other end has a pump impeller on a shaft driven by an external motor to force liquid into the cylindrical holder whereupon it flows out through the material being treated. An injection impeller on the same shaft draws from the expansion compartment liquid which has passed over the partition.

12 Claims, 4 Drawing Figures

HORIZONTAL AUTOCLAVE TANK FOR THE TREATMENT OF TEXTILE MATERIALS

FIELD OF INVENTION

The invention relates to a horizontal autoclave tank for the treatment of textile materials, in particular for carrying out operations for bleaching and dyeing rolls of fabric or reels of yarn. The invention will be used more particularly in the textile industry and in particular in the dyeing industry.

BACKGROUND OF THE INVENTION

Horizontal autoclave tanks are provided with a removable cover which must be sealed hermetically. A material holder which may receive the textile material to be treated in the form of a beam of woven or knitted fabric or a reel of yarn may be introduced into the tank generally by means of lateral rails on which it travels by means of rollers with which it is provided.

In general, the cover is able to pivot and the withdrawal of the material holder is achieved by using a movable transportation carriage which may receive the material holder.

The horizontal autoclave tank is provided with a circulation unit which provides for the circulation of a stream of fluid through the tank and in particular the stream is directed so that it passes through the centre of the textile material to be treated. This circulation unit is generally provided with a cone on which the beam supporting the piece of wound fabric is fitted. The beam comprises a multitude of orifices on its periphery through which passes the stream of treatment fluid which thus penetrates to the actual centre of the roll of woven or knitted fabric. The cone around which the beam fits makes it possible to connect the latter directly to the circulation pump of the unit which thus supplies the inner volume of the hollow beam with treatment fluid.

The horizontal autoclave tank also comprises a series of valves which allow the introduction or elimination of components necessary for carrying out the treatment operation, as well as the necessary safety valves.

Furthermore, the treatment installation comprises an open or closed injection tank as well as an auxiliary injection pump. The autoclave tank is connected to the injection tank through the intermediary of a pipe equipped with a flow-regulating valve. Thus, in particular, increases in the volume of treatment liquid present in the autoclave tank, on account of a temperature rise, are absorbed by the injection tank. Moreover, the residual fluid in the injection tank is returned to the horizontal autoclave tank through the intermediary of an auxiliary injection pump. A permanent circulation of the fluid between the injection tank and the autoclave tank thus occurs. In the case of an open injection tank, it is necessary to provide a high pressure auxiliary injection pump in order to repressurize the fluid before its introduction into the autoclave tank.

In fact it is necessary to keep the autoclave tank under pressure in order to prevent the treatment fluid from being able to vaporize, in particular in the vicinity of the impeller of the circulation unit by a cavitation effect.

It should also be noted that the presence of an attached injection tank has numerous drawbacks. On the one hand, this makes it necessary to use a volume of treatment fluid greater than that strictly necessary, if only to fill the pipes which connect the autoclave tank to the injection tank. Moreover, the characteristics of the treatment fluid present in the injection tank do not necessarily correspond to those of the fluid present in the autoclave tank, in particular, the temperatures may be substantially different and the emptying of the bath present in the injection tank may be less than that present in the autoclave tank, for example, because the dye of the fluid in the injection tank may not yet be transferred to the textile material.

Consequently, the treatment fluid which is returned to the autoclave tank through the intermediary of the auxiliary injection pump has characteristics different from the main bath present in the tank and consequently local non-homogeneity of the bath may follow, which will cause a dyeing fault.

SUMMARY OF INVENTION

The main object of the present invention is to provide a horizontal autoclave tank which is completely integrated, that is to say that it also comprises the injection tank. In this way, the quantity of treatment fluid is reduced to the minimum and the homogeneity of the bath is complete. Moreover, in a preferred embodiment, the main circulation unit has been paired with the injection unit, hence greater simplicity of construction and the saving of a motor.

According to the present invention there is provided a horizontal autoclave tank for the treatment of textile materials, in particular for carrying out operations for bleaching or dyeing woven or knitted fabrics in rolls or yarn in reels, which comprises a removable cover, a material holder comprising one or more internal pipes for the circulation of treatment fluid, a pump for the circulation of treatment fluid in the tank and pipes for filling and emptying the tank, wherein the tank further comprises an inner wall, the height of which is less than that of the tank, which defines two compartments in the tank, one compartment containing the textile material to be treated which is filled with treatment fluid forming the bath, the other compartment acting as an expansion vessel, in that it is filled with a small amount of treatment liquid, but receives the excess liquid passing over the top of the wall and coming from the first treatment compartment.

BRIEF DESCRIPTION OF DRAWINGS

An embodiment of the present invention will now be described, by way of example, with reference to the accompanying drawings, in which.

DESCRIPTION OF PREFERRED EMBODIMENT

The invention relates to a horizontal autoclave tank for the treatment of textile materials. In particular it makes it possible to carry out operations for bleaching or dyeing woven or knitted fabrics in rolls or yarn in reels. In the example chosen in order to illustrate the invention, a beam material holder has been taken, which is intended to receive fabric in the form of rolls. However, the transformation of the material holder in order to receive reels of yarn is within the scope of a man skilled in the art and has already formed the subject of numerous constructions for this type of horizontal autoclave tank.

Figure 1:
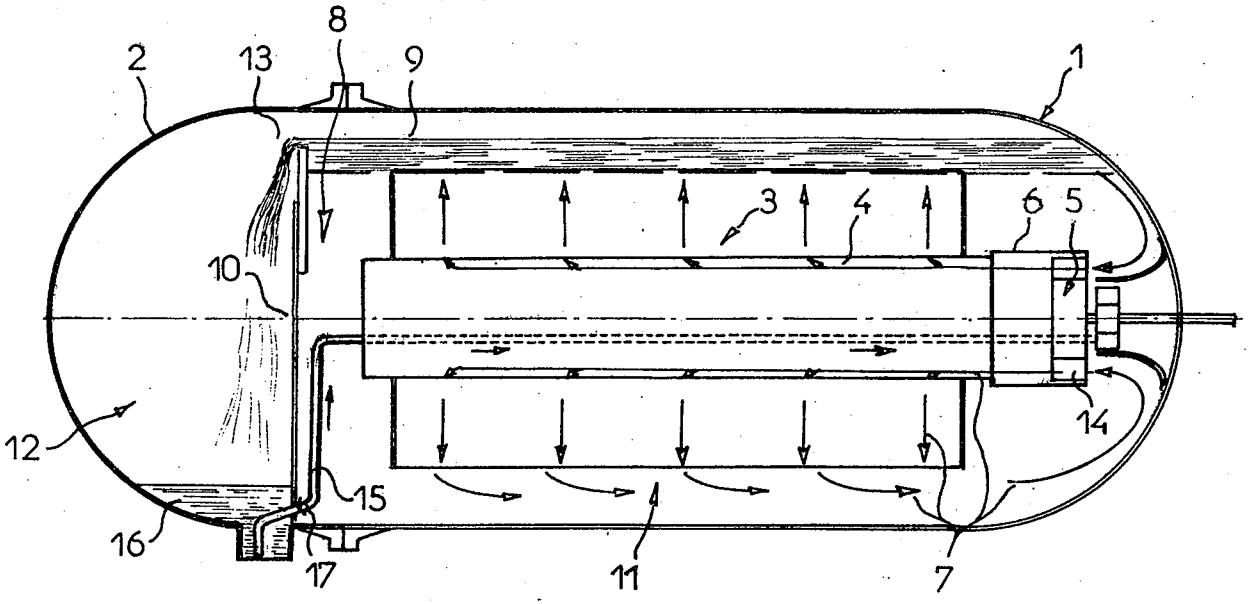
FIG. 1 shows diagrammatically a section of the horizontal autoclave tank of the invention.

The autoclave treatment tank 1 such as that illustrated in FIG. 1 comprises a removable cover 2 which seals the tank 1 hermetically.

The material 3 to be treated which in this case is in the form of a roll of fabric is located on a material holder comprising in particular a beam 4 supported by a cradle (not shown). In this respect, it should be noted that it is imperative to fix the various parts present in the tank firmly, in order that no part moves during the circulation of the treatment fluid.

The beam 4 comprises a periphery provided with a multitude of perforations or a grille, its end being blocked in order that when injecting treatment fluid inside the beam, this fluid escapes through the peripheral orifices and penetrates the roll 3 of fabric.

This circulation of treatment fluid is carried out by a circulation pump 5 stream-lined by a connecting sleeve 6 in which the beam 4 slides in order that its inner volume may be supplied directly with treatment fluid by the circulation pump 5. This circulation pump 5 sucks in treatment fluid present in the tank 1 through the other end of the sleeve 6.

In this way, a circulation of treatment fluid is achieved in accordance with the arrows 7 shown in FIG. 1.

The treatment fluid present in the tank forms a bath 8 whereof the upper level 9 covers the textile material 3 to be treated.

Moreover, the autoclave treatment tank 1 comprises pipes for filling, heating and emptying the tank (not shown) as well as safety valves.

The tank of the present invention also comprises an inner wall 10 whereof the height is less than that of the tank which defines two compartments in the autoclave tank 1, the first treatment compartment 11 contains the textile material 3 to be treated and is filled with the treatment fluid 8 which forms the bath. The other compartment 12 acts as an expansion vessel, in that initially it is not filled with treatment fluid or at the least only slightly and which receives the excess liquid 13 passing over the top of the wall 10 and coming from the first treatment compartment 11.

Due to this design, the traditional injection tank of treatment installations comprising a horizontal autoclave tank has been integrated. The overflowing of liquid into the treatment compartment 11 which is caused by an increase in the volume of fluid by expansion or owing to circulation turbulence, is collected in the expansion compartment 12.

Moreover, an injection pump 14 which can be attached or preferably integrated in the tank 1 removes the fluid 16 present in the bottom of the expansion compartment 12, through the intermediary of an injection pipe 15 and reinjects it into the treatment compartment 11.

In this way, apart from the general circulation of the fluid in the treatment compartment 11, auxiliary circulation of the fluid via the expansion compartment 12 is created. Since the two compartments 11 and 12 are located in the same enclosure 1 and are interconnected, they are under the same static pressure and thus the injection of fluid from one compartment to the other causes no problems of intermediate recompression.

Moreover, on account of the immediate proximity of the two compartments which are located in the same tank, the temperature of the fluid present in the expansion compartment 12 is identical to that in the treatment compartment 11, likewise, as regards the characteristics of emptying the bath, the homogeneity of the treatment is thus perfect. A non-return valve 17 will be located in the injection pipe 15 in order to prevent filling of the expansion compartment 12 via this pipe 15, when the injection pump 14 is not actuated.

Figure 2:
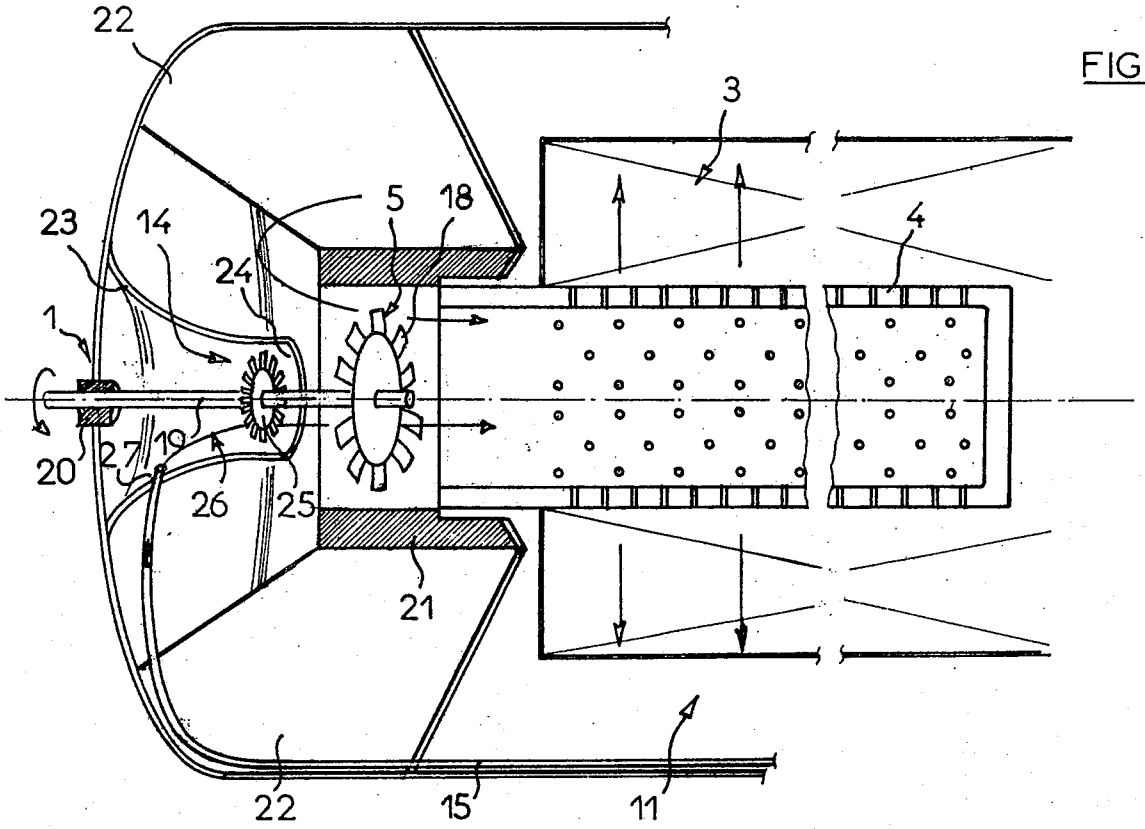
FIG. 2 shows the operation of the circulation and injection pump.

FIG. 2 shows the preferred embodiment which has been adopted in the combined design of the injection pump 14 and circulation pump 5.

The circulation pump 5 comprises an impeller 18 mounted on a shaft 19 set in rotation by an external motor (not shown). The shaft 19 passes through the tank 1 via a stuffing-box 20 ensuring a perfect seal. The impeller 18 is stream-lined in a generally conical sleeve 21 in which the beam 4 of the material holder fits. The sleeve 21 is supported by ribs 22 which guide and stabilize the stream of treatment fluid circulating in the tank 1.

The connection of the beam 4 in the sleeve 21 means that the fluid leaving the circulation pump 5 is conveyed into the inner part of the beam 4 provided with peripheral orifices through which the fluid leaves, thus passing through the textile material 3 to be treated.

Moreover, a central deflecting profile 23, in the form of a truncated cone with a rounded generatrix is located around the drive shaft 19. The outer shape of this deflecting profile 23 promotes the circulation of fluid and in particular the introduction of this fluid into the circulation pump 5. The central deflecting profile 23 which rests on the tank 1 will preferably be hollow and will be open at one of its ends 24 directed towards the circulation pump 5. An impeller 25 will be mounted on the shaft 19 so that it is enclosed by the deflecting profile 23. The blades of the injection impeller 25 are orientated so that it has a tendency to expel the fluid 26 present in the profile 23 from the latter and more particularly in the direction of the circulation pump 5.

The injection pipe 15, whereof one end is located in the bottom of the expansion compartment 12, has its other end 27 opening out inside the deflecting profile 23. Thus, the injection impeller 24 will cause a suction phenomenon in the profile 23 which will have the effect of injecting fluid, taken from the expansion compartment 12, into the main treatment compartment 11.

According to the preferred embodiment described here, the circulation and injection pumps are combined and require only one drive motor.

Figure 3:
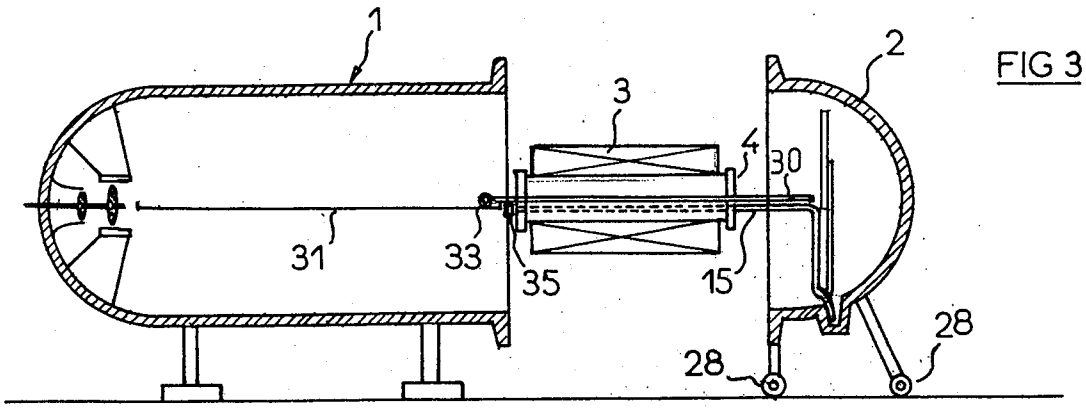
FIG. 3 shows the autoclave tank of the invention in the open position.
Figure 4:
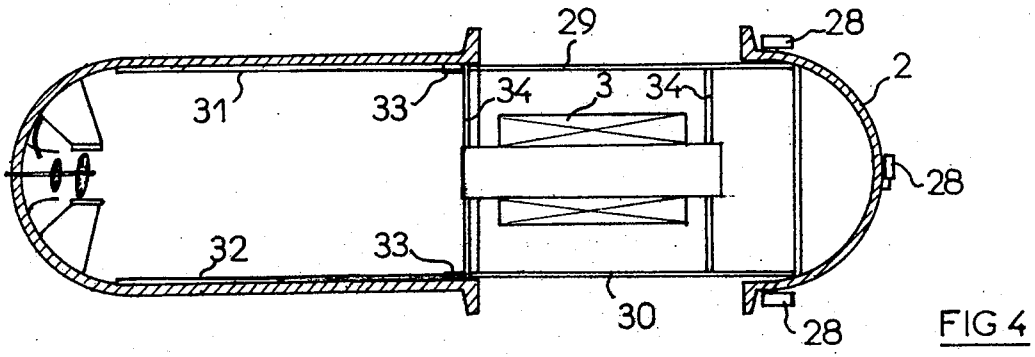
FIG. 4 is a plan view of the autoclave tank of the invention, in the open position.

Filling or emptying of the autoclave treatment tank is illustrated in FIGS. 3 and 4. The removable cover 2 is provided with means for longitudinal movement such as wheels 28. Furthermore, the cover 2 is equipped with two lateral girders 29 and 30 which are able to move longitudinally in rails 31 and 32 fixed in the tank 1. The longitudinal movement is ensured for example by the presence of small rollers 33 at the end of the girders 29 and 30. The girders 29 and 30 also serve as supports for two transverse cradles 34 which themselves serve to support the beam 4.

Locking means will be fitted in order that when reclosing the tank, the material holder and the material are completely immobilized inside.

The injection pipe 15 will be made in two parts with an intermediate coupling 35 which will make it possible to ensure the joint between the two members when closing the tank.

The preferred embodiment which has been adopted in this case has been given solely by way of example and other embodiments, within the scope of a man skilled in the art, could have been envisaged without diverging from the scope of the invention.

An improvement may be applied to the autoclave tank described previously by providing the latter with means for adjusting the upper level of the bath in the treatment compartment. In fact, in this latter case, it is possible to optimize the ratio of the volume of bath to the volume of the material to be treated, by adjusting the height of the wall 10 in order that the upper level of the bath just covers the material to be treated. In this case, dyeing is uniform and the quantity of dye used is reduced to the bare minimum.

In practice, this results for example in an adjustment of height of the wall 10, which may be achieved by using a lower fixed wall 10*a* and an upper wall 10*b* sliding with respect to the former and which will serve for regulation.

It should also be noted that regulating the level of the bath may also be achieved by means of an indentation provided in the wall, the depth of which is adjusted by means of an autoclave member.

With these devices, filling of the tank and in particular of the treatment compartment will be achieved so that the level is flush with the wall 10 without any filling of the expansion vessel compartment taking place.

What is claimed is:

1. Apparatus for the treatment of textile materials, in particular for bleaching or dyeing woven or knitted fabric in rolls or yarn in reels, which comprises a horizontal autoclave tank closed at one end, and a removable cover closing the other end of said tank, a transverse partition near one end of said tank extending up from the bottom of said tank and dividing said tank into a treatment compartment and a closed expansion pressure compartment, said partition having an overflow below the upper wall of said tank defining a liquid level in said treatment compartment below the top of said tank, said expansion compartment receiving excess liquid passing over said overflow from said treatment compartment, a horizontal material holder supported axially in said treatment compartment, a horizontal material holder supported axially in said treatment compartment of the tank, said material holder comprising a perforate cylinder one end of which is closed, circulation pump means in said treatment compartment at the end of said cylinder opposite said closed end for forcing liquid in said tank unidirectionally into said cylinder, whereupon said liquid flows out through material on said holder, and means for returning liquid from said expansion compartment to said treatment compartment.

2. Apparatus according to claim 1, in which said pump means comprises a pump impeller on a horizontal shaft coaxial with said cylinder and axially extending through an end said tank and driven by a motor outside said tank.

3. Apparatus according to claim 2, in which said pump means further comprises a sleeve coaxial with said material holder and surrounding said pump impeller.

4. Apparatus according to claim 3, in which said pump impeller comprises a central portion and a plurality of blades radiating therefrom.

5. Apparatus according to claim 2, in which said means for returning liquid from said expansion compartment to said treatment compartment comprises an injection impeller on said shaft between said pump impeller and the end of said tank and a streamlined, hollow deflecting profile having a discharge end directed toward said pump impeller, and conduit means connecting the interior of said deflecting profile with a lower portion of said expansion compartment.

6. Apparatus according to claim 2, in which the end of said tank through which said shaft extends is said closed end of said tank.

7. Apparatus according to claim 1, in which said cover is equipped with two lateral girders which are movable longitudinally on rails fixed in said tank, and in which said material holder is supported by two transverse cradles extending between said girders.

8. Apparatus according to claim 1, in which means is provided for varying the height of said overflow of said partition to vary the upper level of liquid in said treatment compartment and thereby vary the amount of liquid in said treatment compartment.

9. Apparatus for the treatment of textile material, in particular for bleaching or dyeing woven or knitted fabrics in rolls or yarn in reels, which comprises a horizontal autoclave tank closed at one end, a removable cover closing the other end of said tank, a material holder supported axially in said tank, said material holder comprising a horizontal perforate cylinder one end of which is closed, circulation pump means in said tank for forcing liquid in said tank into said cylinder, whereupon said liquid flows out through material on said holder, a transverse partition near one end of said tank extending up from the bottom of said tank and dividing said tank into a treatment compartment containing said material holder and pump means, and a closed expansion pressure compartment, said partition having an overflow below the upper wall of said tank defining a liquid level in said treatment compartment below the top of said tank, said expansion compartment receiving excess liquid passing over said overflow from said treatment compartment, means for returning said liquid from said expansion compartment to said treatment compartment, and means for varying the height of said overflow of said partition to vary the upper level of liquid in said treatment compartment and thereby vary the amount of liquid in said treatment compartment.

10. Apparatus according to claim 9, in which said partition comprises a lower fixed part and an upper vertically movable part defining said overflow, the height of said overflow being varied by raising or lowering said vertically movable part.

11. Apparatus according to claim 9, in which said cover is dome-shaped and in which said partition is installed in said cover.

12. Apparatus according to claim 9, in which said cover is equipped with two lateral girders which are movable longitudinally on rails fixed in said tank, and in which said material holder is supported by two transverse cradles extending between said girders.

* * * * *